US006786185B2

(12) United States Patent
Pierik

(10) Patent No.: US 6,786,185 B2
(45) Date of Patent: Sep. 7, 2004

(54) VARIABLE VALVE ACTUATION MECHANISM HAVING PARTIAL WRAP BEARINGS FOR OUTPUT CAMS AND FRAMES

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 126 days.

(21) Appl. No.: 10/097,331

(22) Filed: Mar. 14, 2002

(65) Prior Publication Data

US 2003/0172886 A1 Sep. 18, 2003

(51) Int. Cl.[7] ..... F01L 1/34

(52) U.S. Cl. ..... 123/90.16; 123/90.15; 123/90.6; 74/567

(58) Field of Search ..... 123/90.6, 90.15–90.17; 74/569, 595, 55, 596, 597, 598

(56) References Cited

U.S. PATENT DOCUMENTS 3,203,716 A * 8/1965 Lannen ..... 403/52
4,651,687 A * 3/1987 Yamashita et al. ..... 123/182.1
5,114,000 A * 5/1992 Rappen ..... 198/499
5,193,418 A * 3/1993 Behrenfeld ..... 81/121.1
5,253,546 A * 10/1993 Elrod et al. ..... 74/567
5,577,469 A * 11/1996 Muller et al. ..... 123/90.16
5,624,142 A * 4/1997 Watson et al. ..... 292/241
5,937,809 A 8/1999 Pierik et al.
5,992,367 A * 11/1999 Santi et al. ..... 123/182.1
6,041,746 A * 3/2000 Takemura et al. ..... 123/90.16
6,382,149 B1 * 5/2002 Fischer et al. ..... 123/90.16
6,386,161 B2 5/2002 Pierik
6,390,041 B2 * 5/2002 Nakamura et al. ..... 123/90.15

* cited by examiner

*Primary Examiner*—Thomas Denion
*Assistant Examiner*—Jaime Corrigan
(74) *Attorney, Agent, or Firm*—Patrick M. Griffin

(57) ABSTRACT

A variable valve actuation (VVA) mechanism includes a partial wrap output cam assembly and a partial wrap frame assembly. Each of the partial wrap cam assembly and the partial wrap frame assembly include a respective body and a respective shaft engaging means coupled to the body. The shaft-engaging means are configured for engaging an input shaft with a snap fit to thereby pivotally dispose the output cam assembly and the frame assembly upon the input shaft.

18 Claims, 5 Drawing Sheets

VARIABLE VALVE ACTUATION MECHANISM HAVING PARTIAL WRAP BEARINGS FOR OUTPUT CAMS AND FRAMES

TECHNICAL FIELD

The present invention relates to variable valve actuating mechanisms.

BACKGROUND OF THE INVENTION

Modern internal combustion engines may incorporate advanced throttle control systems, such as, for example, intake valve throttle control systems, to improve fuel economy and performance. Generally, intake valve throttle control systems control the flow of gas and air into and out of the engine cylinders by varying the timing, duration and/or lift (i.e., the valve lift profile) of the cylinder valves in response to engine operating parameters, such as engine load, speed, and driver input. For example, the valve lift profile is varied from a relatively high-lift profile under high-load engine operating conditions to a reduced/lower lift profile under engine operating conditions of moderate and low loads.

Intake valve throttle control systems vary the valve lift profile through the use of variously-configured mechanical and/or electromechanical devices, collectively referred to herein as variable valve actuation (VVA) mechanisms. Several examples of particular embodiments of VVA mechanisms are detailed in commonly-assigned U.S. Pat. No. 5,937,809, the disclosure of which is incorporated herein by reference.

Generally, a conventional VVA mechanism includes a rocker arm that is displaced in a generally radial direction by a corresponding input cam of an input shaft, such as the engine camshaft. The displacement of the rocker arm is transferred via a link arm to pivotal oscillation of an output cam relative to the input shaft. The pivotal oscillation of the output cam is transferred to actuation of an associated valve by a cam follower, such as, for example, a roller finger follower. A desired valve lift profile is obtained by orienting the output cam into a starting or base angular orientation relative to the cam follower and/or the central axis of the input shaft. The starting or base angular orientation of the output cam determines the portion of the lift profile thereof that engages the cam follower as the output cam is pivotally oscillated, and thereby determines the valve lift profile. The starting or base angular orientation of the output cam is set via a control shaft that pivots a frame member and, via the rocker and link, the output cam relative to the cam follower and/or the central axis of the input shaft.

In a multi-cylinder engine, the camshaft extends the entire length of the engine cylinder head and includes at least one cam lobe for each cylinder. The cam lobes are typically formed integrally with the camshaft, such as by machining, and are spaced along the length of the camshaft. At least a portion of the cam lobes extend outside the diameter of the camshaft. Thus, the components of the WA that are slidingly received over and mounted onto the camshaft can not be slid past the point where the first cam lobe is positioned on the camshaft. Several approaches exist that enable placement of the components of a VVA along the length of a camshaft, and on either side of the cam lobes formed thereon, thereby enabling a VVA mechanism to be associated with each cylinder.

One approach segments the camshaft into multiple sections, each of which correspond to a respective cylinder of the engine. Segmentation of the camshaft permits components of the VVA mechanism to be slid into position on either side of the cam lobe. Further, segmentation of the camshaft enables VVA mechanisms to be installed for each cylinder. However, segmentation of the camshaft increases the number of machining operations required and thus increases machining costs. Further, using segmented camshafts for each cylinder requires precise alignment of the segments relative to each other. The alignment process is time-consuming, labor intensive and costly.

Another approach uses oversized WA components. The components of the VVA mechanism are made larger so that they can be slid over the cam lobes and into association with each cylinder. However, oversized components are more costly to produce, consume more space within the engine cylinder head, and undesirably increase the weight of an engine and/or vehicle.

Yet another approach is to split the components of the VVA that are pivotally coupled to the input or camshaft into two pieces. For example, an output cam is split into upper and lower pieces. The pieces are then placed in the desired position on the camshaft and coupled together with fasteners, such as bolts, thereby pivotally coupling the split output cam to the camshaft. However, the fasteners increase the part count and make assembly of the VVA mechanism more time consuming and more complex. Further, fasteners may become loose over time or even disengage, causing the VVA mechanism to malfunction and potentially causing damage to the engine.

Therefore, what is needed in the art is a variable valve mechanism having a one-piece, unitary camshaft, thereby eliminating the need to align camshaft segments with each other.

Furthermore, what is needed in the art is a WA mechanism having fewer component parts.

Still further, what is needed in the art is a WA mechanism that does not require the use of over-sized component parts in order to be positioned on either side of a cam lobe and/or at any position along the camshaft.

Moreover, what is needed in the art is a VVA mechanism that does not require the use of split components in order to be positioned on either side of a cam lobe and/or at any position along the camshaft.

SUMMARY OF THE INVENTION

The present invention provides a variable valve actuation mechanism having an output cam and frame assembly that engage and are retained upon the camshaft of an engine with a snap fit.

The invention comprises, in one form thereof, a partial wrap output cam assembly and a partial wrap frame assembly. Each of the partial wrap cam assembly and the partial wrap frame assembly include a respective body and a respective shaft engaging means coupled to the body. The shaft-engaging means are configured for engaging an input shaft with a snap fit to thereby pivotally dispose the output cam assembly and the frame assembly upon the input shaft.

An advantage of the present invention is that the partial wrap frame and output cam assemblies eliminate the need to segment the camshaft, and the alignment process associated with a segmented camshaft.

A further advantage of the present invention is that the components can be placed on either side of an input cam lobe, or virtually anywhere along the length of a camshaft or input shaft.

An even further advantage of the present invention is that the VVA mechanism of the present invention can be at least partially assembled and retained upon a camshaft, thereby facilitating final installation in an engine.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
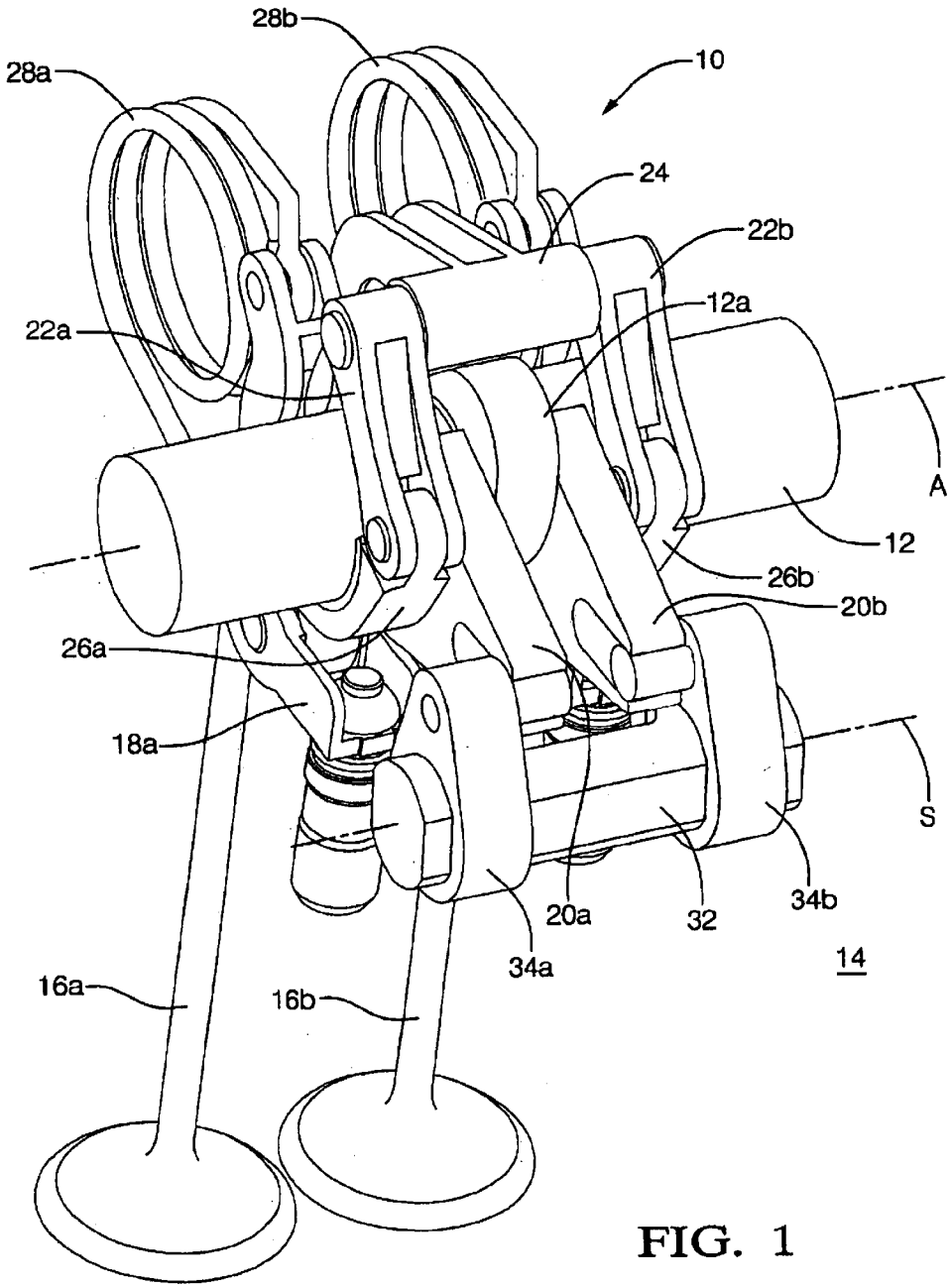
FIG. 1 is a perspective elevated front view of one embodiment of a variable valve actuation (VVA) mechanism of the present invention operably installed within an internal combustion engine.
Figure 2:
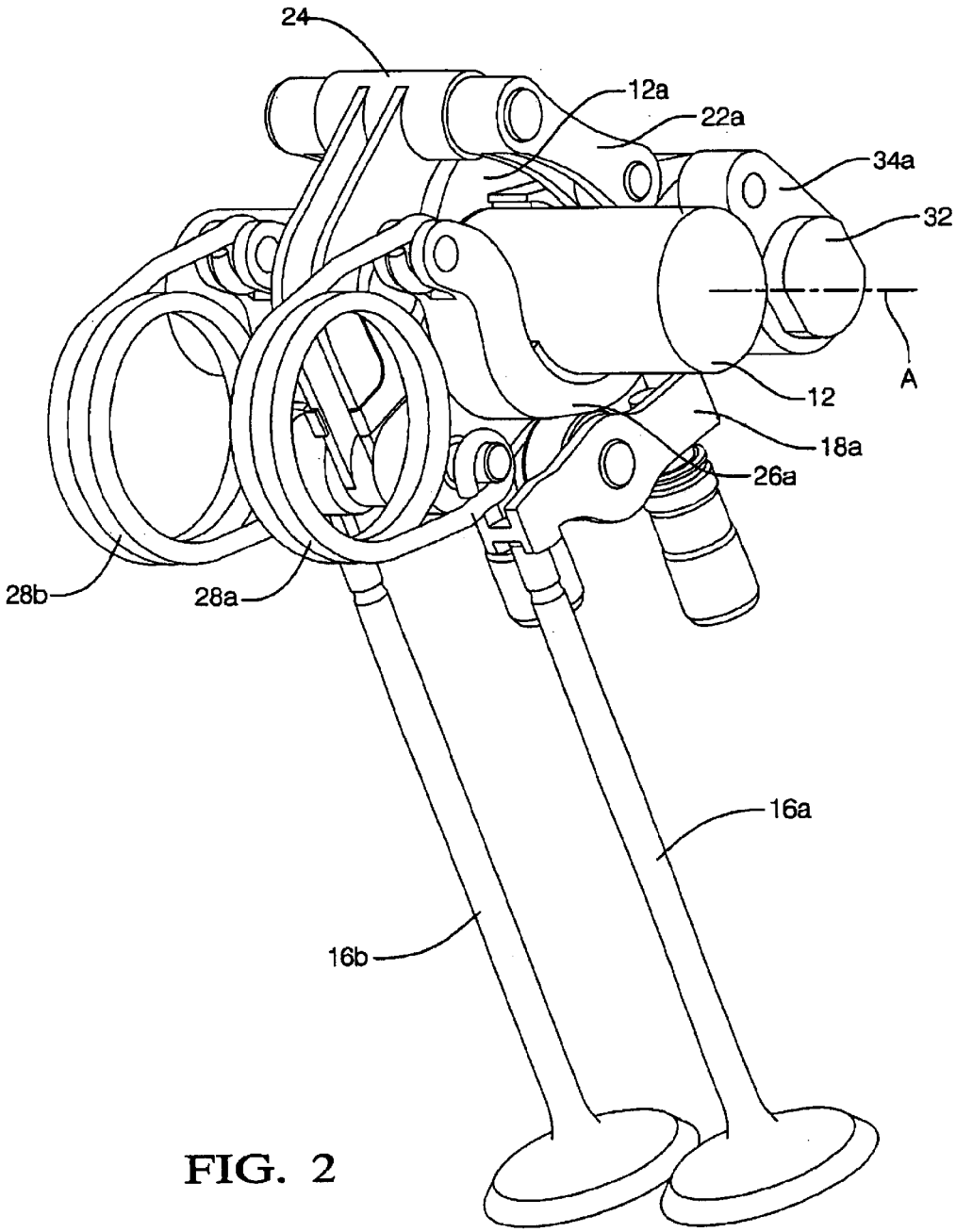
FIG. 2 is a perspective side/rear view of the VVA mechanism of FIG. 1.
Figure 3:
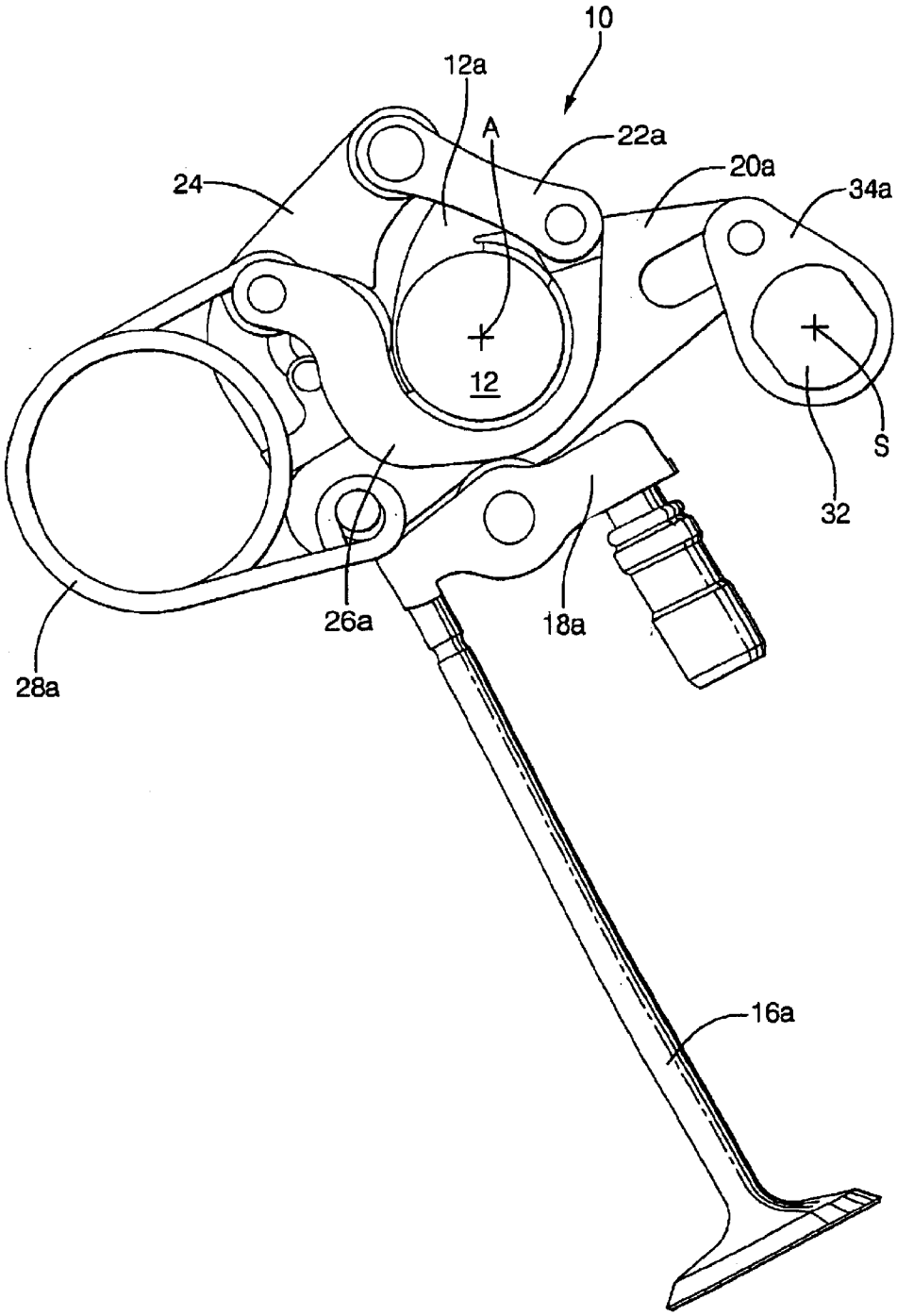
FIG. 3 is a perspective end view of the VVA mechanism of FIG. 1.

Referring now to the drawings, and particularly to FIGS. 1–3, there is shown one embodiment of a VVA mechanism of the present invention. VVA mechanism 10, as will be more particularly described hereinafter, is operably associated with rotary input shaft or camshaft 12 (hereinafter referred to as camshaft 12) of engine 14. Camshaft 12 has a central axis A and includes input cam lobe 12*a*, which rotates as substantially one body with rotary camshaft 12. Valves 16*a* and 16*b* are associated with a cylinder (not shown) of engine 14 and with respective cam followers 18*a* and 18*b* (only one of which is visible).

VVA mechanism 10 includes partial-wrap frame assemblies 20*a* and 20*b*, link arms 22*a* and 22*b*, rocker arm assembly 24, partial-wrap output cam assemblies 26*a* and 26*b*, and return springs 28*a* and 28*b*. Generally, VVA mechanism 10 transfers rotation of input cam lobe 12*a* to pivotal oscillation of output cam assemblies 26*a* and 26*b* to thereby actuate valves 16*a* and 16*b* according to a desired valve lift profile.

Partial wrap frame assemblies 20*a* and 20*b* are pivotally disposed on camshaft 12 on respective sides of input cam lobe 12*a*. More particularly, frame assembly 20*a* is pivotally disposed on camshaft 12 on a first side of input cam lobe 12*a* and frame assembly 20*b* is pivotally disposed on camshaft 12 on a second side of input cam lobe 12*a*. Frame assemblies 20*a* and 20*b* are engaged at a first end (not referenced) thereof by return springs 28*a* and 28*b*, respectively, and to rocker arm assembly 24. Frame assemblies 20*a* and 20*b* at a second end (not referenced) thereof are pivotally coupled by respective coupling means 34*a* and 34*b*, such as, for example, shaft clamps, to control shaft 32.

Figure 4:
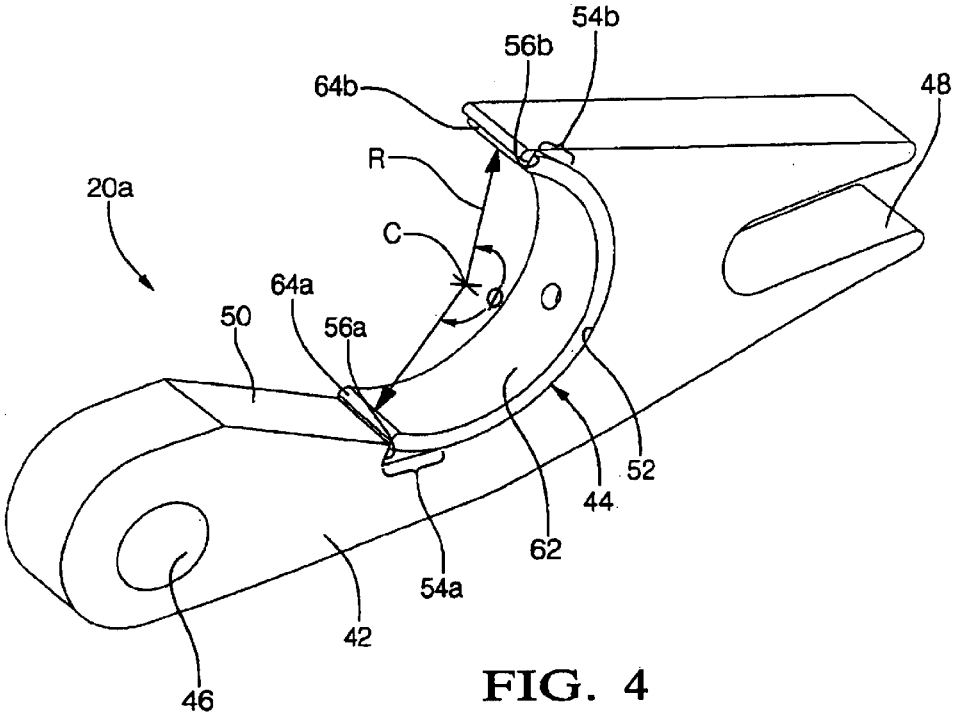
FIG. 4 is a perspective view of the frame assembly of FIG. 1.

Frame assemblies 20*a* and 20*b* are substantially identical, and therefore a detailed description of one shall serve to describe the structure and functionality of both. As best shown in FIG. 4, frame assembly 20*a* includes a generally hook-shaped body 42 and bearing insert 44.

Body 42 defines a bore 46 through a first end (not referenced) thereof and an elongate slot 48 in a second end (not referenced) thereof. Body 42 defines hook-shaped portion 50 including a substantially semi-cylindrical surface 52, and end portions 54*a*, 54*b* thereof that include respective edges or lips 56*a*, 56*b*. Surface 52 has a substantially constant radius (not referenced) relative to centerline C thereof. End portions 54*a*, 54*b* are tapered away from centerline C, i.e., the distance between end portions 54*a*, 54*b* and centerline C increases in a direction radially away from semi-cylindrical surface 52. End portions 54*a* and 54*b* are terminated by edges 56*a* and 56*b*, respectively. Bore 46 receives a fastener (not shown), such as, for example, a spring pin, to thereby couple together return spring 28*a* and frame assembly 20*a*.

Bearing insert 44 includes body 62 having ends 64*a*, 64*b*, and is constructed of a resiliently-deformable material, such as, for example, steel or aluminum. Generally, bearing insert 44 is received into engagement and retained by a snap fit with semi-cylindrical surface 52, and is thereby coupled to body 42. More particularly, the bottom or outer surface (not referenced) of bearing insert 44 is disposed in engagement with semi-cylindrical surface 52. Bearing insert 44 has an outside radius (not referenced) that is substantially equal to the radius (not referenced) of semi-cylindrical surface 52. Bearing insert 44 has an inside radius R that is substantially equal to the radius (not referenced) of camshaft 12. Angle Ø is defined between ends 64*a* and 64*b* of bearing insert 44 and centerline C of semi-cylindrical surface 52. Angle Ø is greater than one hundred eighty degrees, and preferably from approximately one hundred eighty-one degrees (181°) to approximately two hundred twenty-five degrees (225°).

The linear distance between the radially outside surfaces (not referenced) of ends 64*a* and 64*b* is a predetermined amount greater than the distance separating the radially inner or top surfaces (not referenced) of edges 56*a*, 56*b*, i.e., the portion of edges 56*a*, 56*b* that are disposed most proximate to center C. Thus, at least a portion of ends 64*a* and 64*b* of bearing insert 44 are disposed radially outside of edges 56*a*, 56*b*, respectively, relative to centerline C. Ends 64*a* and 64*b* are disposed in close proximity and/or in abutting engagement with edges 56*a* and 56*b*, respectively, of semi-cylindrical surface 52. Thus, edges 56*a*, 56*b* limit displacement of bearing insert 44 in a direction generally tangential to semi-cylindrical surface 52.

Bearing insert 44 is coupled to body 42 of frame assembly 20*a* by pushing bearing insert 44 in a generally downward direction (i.e., in a direction generally from bore 46 towards slot 48) such that the outer surface thereof engages semi-cylindrical surface 52. As bearing insert 44 is displaced in the generally downward direction, ends 64*a* and 64*b* are deflected inward by edges 56*a*, 56*b*. Once clear of edges 56*a*, 56*b*, the resilient nature of bearing insert 44 causes ends 64*a* and 64*b* to deflect in a generally radial direction and outward relative to centerline C thereby disposing at least a portion of ends 64*a* and 64*b* radially outside of edges 56*a*, 56*b* relative to centerline C.

In general, frame assembly 20*a* is pivotally disposed and retained upon camshaft 12 by a snap fit between the outer surface (not referenced) of camshaft 12 and bearing insert 44. More particularly, frame assembly 20*a* is pushed onto camshaft 12 such that the open portion (not referenced) of bearing insert 44 receives at least a portion of camshaft 12, and in a direction that attempts to align centerline C of semi-cylindrical surface 52 and central axis A of camshaft 12. As described above, bearing insert 44 is constructed of a resiliently-deformable material and has an inside radius R that is substantially equal to the radius of camshaft 12. Since angle Ø is from approximately one hundred eighty-one degrees (181°) to approximately two hundred twenty-five degrees (225°), bearing insert 44 is deformed as frame assembly 20*a* is "pushed" onto camshaft 12.

More particularly, ends 64*a*, 64*b* of bearing insert 44 are displaced in a generally radial direction and forced into the tapered or non-constant radius ends 54*a*, 54*b* of hook-shaped portion 50. Once past the diameter of camshaft 12, ends 54*a* and 54*b* of bearing insert 44 snap back into the position depicted in FIG. 4. Thus, frame assembly 20*a* is disposed and retained upon camshaft 12 by a snap or interference fit between bearing camshaft 12 and insert 44, which, in turn, is coupled to frame assembly 20*a* by a similar snap or interference fit.

As stated above, frame assembly 20*b* is substantially identical to frame assembly 20*a*. Thus, frame assembly 20*b* includes a bearing insert (not shown or referenced) that is substantially identical to bearing insert 44. Frame assembly 20*b* is pivotally coupled to camshaft 12 in a substantially similar manner as that described above in regard to frame assembly 20*a*. Further, frame assembly 20*b* is also pivotally coupled to control shaft 32.

Thus pivotally disposed upon camshaft 12 and pivotally coupled to control shaft 32, frame assemblies 20*a* and 20*b* are not rotated by the rotation of camshaft 12. Rather, camshaft 12 is free to rotate about central axis A and relative to frame assemblies 20*a* and 20*b*, and frame assemblies 20*a* and 20*b* are pivotable relative to camshaft 12 and central axis A thereof.

Link arms 22*a* and 22*b* are elongate arm members that are pivotally coupled at a first end thereof to opposite sides of rocker arm assembly 24 and at a second end thereof to a respective output cam 26*a* and 26*b*.

Rocker arm assembly 24 is pivotally coupled, such as, for example, by pins (not referenced), at a first end thereof to frame assemblies 20*a*, 20*b* and at a second end thereof to link arms 22*a* and 22*b*. Rocker arm assembly, as is known in the art, carries one or more rollers or slider pads (not shown) that engage each of output cams 26*a*, 26*b*.

Partial wrap output cams 26*a* and 26*b* are pivotally disposed upon camshaft 12. More particularly, output cam 26*a* is pivotally disposed upon camshaft 12 on a first side of input cam lobe 12*a*, and output cam 26*b* is disposed on a second side of input cam lobe 12*a*. At respective first ends thereof, output cam 26*a* is pivotally coupled to link arm 22*a* and output cam 26*b* is pivotally coupled to link arm 22*b*, and at respective second ends thereof output cam 26*a* is coupled to spring 28*a* and output cam 26*b* is coupled to spring 28*b*.

Figure 5:
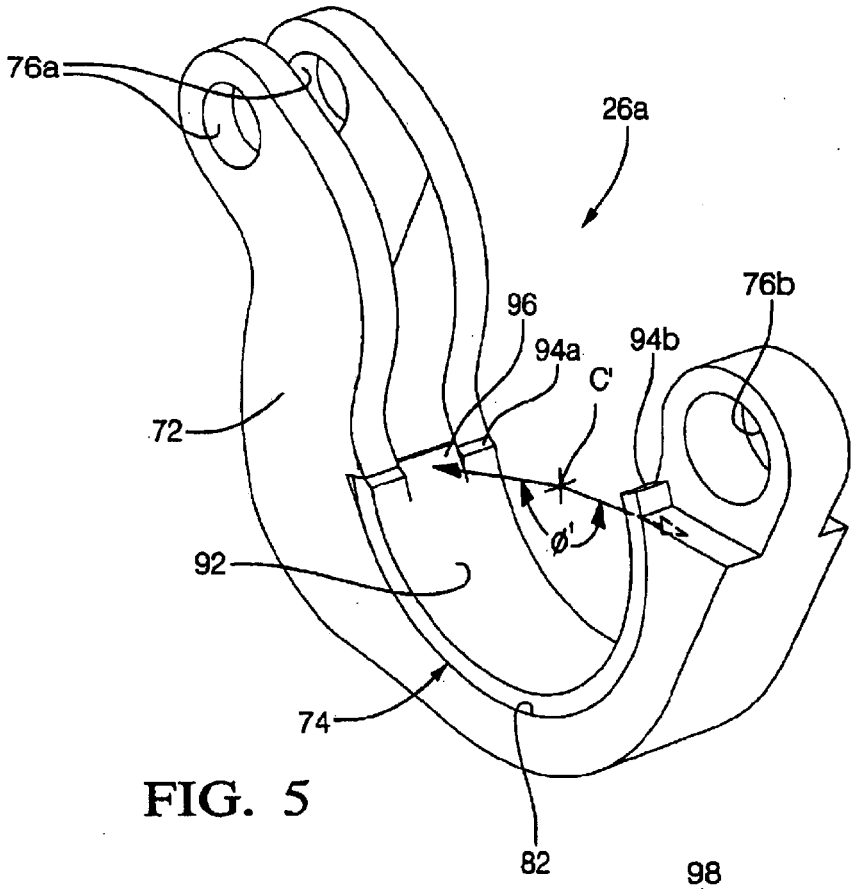
FIG. 5 is a perspective view of the output cam assembly of FIG. 1.
Figure 6:
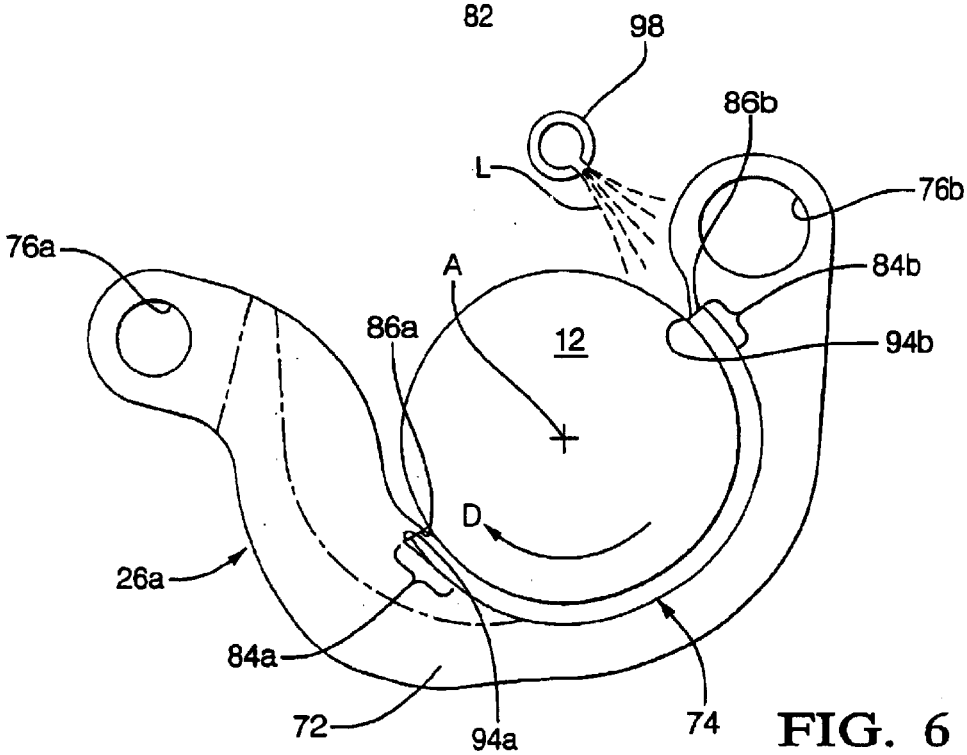
FIG. 6 is an end view of the output cam assembly and input shaft of FIG. 1.

Output cams 26*a* and 26*b* are substantially identical, and therefore a detailed description of one shall serve to describe the structure and functionality of both. As best shown in FIGS. 5 and 6, output cam 26*a* includes a generally hook-shaped body 72 and bearing insert 74.

Body 72 defines bores 76*a* and bore 76*b* at opposite ends (not referenced) thereof. Body 72 includes substantially semi-circular portion 82 and end portions 84*a* and 84*b* that are terminated by respective lips 86*a* and 86*b*. Semi-circular portion 82 has a substantially constant radius centered upon centerline C'. End portions 84*a*, 84*b* are tapered away from centerline C', i.e., the distance between end portions 84*a*, 84*b* and centerline C' increases in a direction radially away from semi-cylindrical surface 82. Bores 76*a* receive a coupler (not referenced), such as, for example, a spring pin, to pivotally couple output cam 26*a* to return spring 28*a*. Bore 76*b* receives a fastener (not referenced), such as, for example, a spring pin, to thereby couple output cam 26*a* to link arm 22*a*.

Bearing insert 74 includes body 92 having ends 94*a*, 94*b*, and is constructed of a resiliently-deformable material, such as, for example, steel or aluminum. Generally, bearing insert 74 is received into engagement and retained by a snap fit with semi-cylindrical portion 82. Bearing insert 74 is coupled to body 72 in a substantially similar manner as described above in regard to bearing insert 44 being coupled to hook-shaped portion 50, and is therefore not described in detail. However, it should be particularly noted that bearing insert 74 includes tab 96 that is displaced outwardly from bearing insert 74 in a generally radial direction relative to centerline C'. Tab 96 is disposed between and/or engages an inside surface of the walls (not referenced) of body 72 of output cam 26*a*, and thereby provides axial alignment of and/or positively locates bearing insert 74 relative to output cam 26*a*.

Bearing insert 74 has an inside radius R that is substantially equal to the radius (not referenced) of camshaft 12. Angle Ø' is defined between end portions 94*a* and 94*b* of bearing insert 74 and centerline C' of semi-cylindrical portion 82, or alternatively between ends 84*a*, 84*b* and centerline C'. Angle Ø' is from approximately one hundred eighty-one degrees (181°) to approximately two hundred twenty-five degrees (225°). Bearing insert 74 is coupled to body 72 by pushing bearing insert 74 in a generally downward direction (i.e., in a direction generally from bores 76*a*, 76*b* and toward semi-cylindrical portion 82), such that the outer surface thereof engages semi-cylindrical surface 82. As bearing insert 74 is displaced in the generally downward direction, ends 94*a* and 94*b* are deflected inward in a direction toward centerline C' by lips 86*a*, 86*b*. Once clear of lips 86*a*, 86*b*, the resilient nature of bearing insert 74 causes ends 94*a* and 94*b* to deflect outward relative to centerline C' to thereby dispose at least a portion of ends 94*a* and 94*b* radially outside of lips 86*a*, 86*b* relative to centerline C'.

In general, and substantially similar to frame assemblies 20*a*, output cam 26*a* is pivotally disposed and retained upon camshaft 12 by a snap fit between the outer surface (not referenced) of camshaft 12 and bearing insert 74. More particularly, output cam assembly 26*a* is pushed onto camshaft 12 such that the open portion (not referenced) of bearing insert 74 receives at least a portion of camshaft 12, and in a direction that attempts to align centerline C' of semi-cylindrical portion 82 and central axis A of camshaft 12.

As described above, bearing insert 74 is constructed of a resiliently-deformable material and has an inside radius R that is substantially equal to the radius of camshaft 12. Since angle Ø' is from approximately one hundred eighty-one degrees (181°) to approximately two hundred twenty-five degrees (225°), bearing insert 74 is deformed as output cam assembly 26*a* is "pushed" onto camshaft 12. Ends 94*a*, 94*b* of bearing insert 74 are displaced radially outward and forced into the space created by the non-constant radius ends

84*a*, 84*b* of body 72. Once past the diameter of camshaft 12, ends 94*a* and 94*b* of bearing insert 74 snap back into the position depicted in FIG. 6. Thus, output cam assembly 26*a* is disposed and retained upon camshaft 12 by a snap or interference fit between bearing insert 74 and camshaft 12.

As stated above, output cam assembly 26*b* is substantially identical to output cam assembly 26*a*. Thus, output cam assembly 26*b* includes a respective bearing insert, and is pivotally coupled to camshaft 12 in a substantially similar manner as that described above in regard to output cam assembly 26*a*. Further, output cam assembly 26*b* is also pivotally coupled to its corresponding link arm 22*b*.

Thus pivotally disposed upon camshaft 12 and pivotally coupled to link arms 22*a* and 22*b*, output cam assemblies 26*a* and 26*b* are not rotated by the rotation of camshaft 12. Rather, camshaft 12 is free to rotate about central axis A and relative to output cam assemblies 26*a* and 26*b*, and output cam assemblies 26*a* and 26*b* are pivotable relative to camshaft 12 and central axis A thereof.

Return springs 28*a* and 28*b*, such as, for example, torsion springs, are each coupled at a first end to a respective frame assembly 20*a* and 20*b* and at a second end to a respective output cam 26*a*, 26*b*. As is known in the art, returns springs 28*a*, 28*b*, bias output cams 26*a* and 26*b* back into a base or starting angular orientation relative to central axis A after a valve opening event, and remove lash from VVA mechanism 10.

It should be particularly noted that, as shown in FIGS. 4 and 6, bearing ends 64*a*, 64*b* and 94*a*, 94*b* are chamfered and/or of an increased radius relative to bodies 62 and 92, respectively. More particularly, ends 64*a* and 64*b* are of bearing insert 44 are chamfered at the inside surface thereof in a direction away from camshaft 12 when bearing insert 44 is pivotally disposed in relation thereto. Similarly, ends 94*a* and 94*b* of bearing insert 74 are chamfered at the inside surface thereof in a direction away from camshaft 12 when bearing insert 74 is pivotally disposed in relation thereto.

It should further be particularly noted that, as shown in FIG. 6, lubricating means 98, such as, for example, a spray nozzle or jet, is associated with VVA mechanism 10. More particularly, with output cam assembly 26*a* pivotally disposed upon camshaft 12, lubricating means 98 is disposed proximate to end 94*b* of bearing insert 74. Lubricating means 98 directs a spray of lubricant L toward the interface of camshaft 12 and end 94*b* of bearing insert 74. The chamfer and/or increased radius at end 94*b* of bearing insert 74 facilitates the admission of lubricant L, such as, for example, oil, into the interface of camshaft 12 and bearing insert 74. Lubricating means 98 is disposed such that the spray of lubricant L is drawn into the direction of rotation D of camshaft 12 further facilitates the admission of, i.e., draws, lubricant L into the interface of camshaft 12 and bearing insert 74.

Although not shown in the figures, it should be understood that lubricating means 98 is configured, or a second lubricating means is provided, to direct a second spray of lubricant at the interface of camshaft 12 and end 64*b* of bearing insert 44. Alternatively, the spray of lubricant L is sufficiently dispersed such that it is simultaneously directed to interface of camshaft 12 with each of end 94*b* of bearing insert 74 and end 64*b* of bearing insert 44.

In use, the snap-fit engagement of output cam assemblies 26*a*, 26*b* and frame assemblies 20*a*, 20*b* with camshaft 12 enables at least partial assembly of VVA mechanism 10. The snap fit retains output cam assemblies 26*a*, 26*b* and frame assemblies 20*a*, 20*b* in disposition upon camshaft 12. Further, the snap fit enables output cam assemblies 26*a*, 26*b* and frame assemblies 20*a*, 20*b* to be placed upon camshaft 12 and on either side of input cam lobe 12*a*, without requiring segmentation of camshaft 12. Thus, VVA mechanism 10 eliminates the time consuming process of precisely align segments of a segmented camshaft relative to each other. Further, VVA mechanism 10 does not require the use of over-sized component parts in order to position those components on either side of cam lobe 12*a* and/or at any position along camshaft 12. Still further, VVA mechanism 10 eliminates the need for the use of split components in order to be positioned on either side of cam lobe 12*a* and/or at any position along camshaft 12.

VVA mechanism 10 operates, i.e., varies the valve lift of valves 16*a*, 16*b*, in a substantially similar manner as a conventional VVA mechanism. Generally, a desired valve lift profile for associated valves 16*a*, 16*b* is obtained by placing control shaft 32 in a predetermined angular orientation relative to central axis S (FIGS. 1 and 3) thereof, which, in turn, pivots output cam assemblies 26*a*, 26*b* relative to central axis A. Thus, the desired portion of the lift profiles of output cam assemblies 26*a* 26*b* are disposed within the pivotal oscillatory range thereof relative to cam followers 18*a*, 18*b*. As output cam assemblies 26*a*, 26*b* are pivotally oscillated, the desired portions of the lift profiles thereof engage cam followers 18*a*, 18*b* to thereby actuate valves 16*a* and 16*b* according to the desired lift profile.

Figure 7:
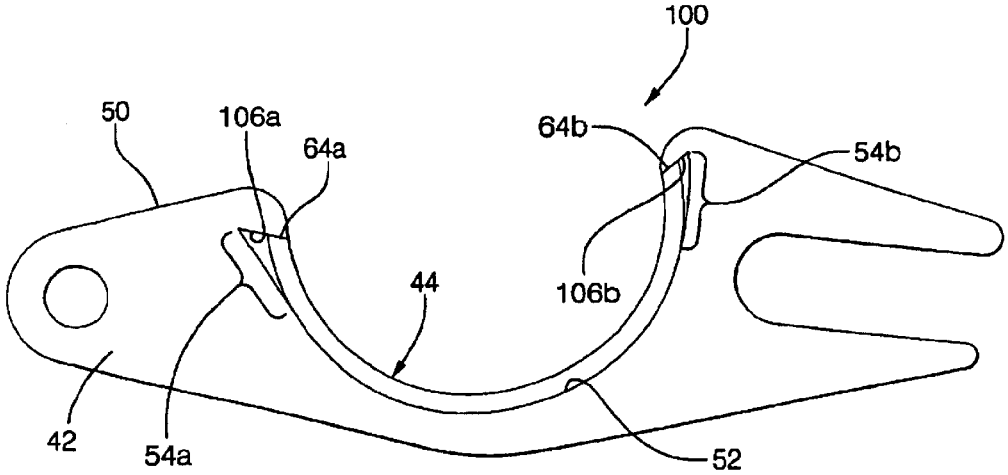
FIG. 7 is a side view of a second embodiment of the frame assembly of the present invention.

Referring now to FIG. 7, a second embodiment of a frame assembly of the present invention is shown. Frame assembly 100 includes features that are generally similar and which correspond to frame assemblies 20*a* and 20*b*, and corresponding reference characters are used to indicate such corresponding features.

Frame assembly 100 is generally similar to frame assemblies 20*a* and 20*b*, and therefore only the distinctions therebetween are discussed hereinafter. Body 42 of frame assembly 100 defines hook-shaped portion 50 including a substantially semi-cylindrical surface 52, and end portions 54*a*, 54*b* thereof that include respective edges or lips 106*a*, 106*b*. In contrast to edges or lips 56*a*, 56*b* of frame assemblies 20*a*, 20*b*, edges 106*a* and 106*b* are angled or tapered at an acute angle (not referenced) relative to semicircular surface 52. The acute angle facilitates installation and coupling of bearing insert 44 to body 42 of frame assembly 100.

More particularly, the acute angle of lips or edges 106*a* and 106*b* enables one of the ends 64*a*, 64*b* of bearing insert 44 to be installed in engagement with a corresponding one of edges 106*a*, 106*b*, and thereafter permitted to resiliently deform back into a substantially semi-circular shape and pivoted in one of a clockwise or counterclockwise direction to thereby install the other of ends 64*a*, 64*b* with its corresponding edge 106*a*, 106*b*.

It should be understood that, although not shown in the drawings, edges 86*a* and 86*b* of output cam assemblies 26*a* and 26*b* can be alternately configured in a manner substantially similar to edges 106*a* and 106*b* of frame assembly 100 as described above.

In the embodiment shown, bearing inserts 44 and 74 are configured for a snap fit with camshaft 12 of engine 14. Accordingly, ends 64*a*, 64*b* and 94*a*, 94*b*, respectively, thereof form angle Ø and angle Ø', respectively, of greater than one hundred eighty degrees 180°, and preferably from approximately one hundred eighty-one degrees (181°) to approximately two hundred twenty-five degrees (225°). However, it is to be understood that the present invention can be alternately configured with bearing inserts that engage the camshaft but are not retained thereon or pivotally coupled thereto by a snap fit. In such a configuration the bearing inserts may form an angle Ø or angle Ø' of less than one hundred eighty degrees 180°.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. An internal combustion engine, said engine having a camshaft, said engine comprising:

a variable valve actuating (WA) mechanism associated with said camshaft, said WA mechanism including at least one of a partial wrap output cam assembly and a partial wrap frame assembly pivotally disposed on said camshaft, wherein said partial wrap output cam assembly includes an output cam body, a first shaft engaging mechanism carried by said output cam body and engaging said camshaft, and wherein said first shaft-engaging mechanism comprises a resiliently-deformable first bearing insert, said first bearing insert engaging said camshaft to thereby pivotally dispose said output cam assembly upon said camshaft.

2. To the engine of claim 1, wherein said first bearing insert is coupled to said output cam body by a snap fit.

3. The engine of claim 1, wherein said output cam body defines a substantially semi-cylindrical surface and opposite end portions adjoining said semi-cylindrical surface, said first bearing insert being received and disposed within said semi-cylindrical surface.

4. The engine of claim 3, wherein said opposite end portions of said semi-cylindrical surface taper in a direction away from a centerline of said semi-cylindrical surface.

5. The engine of claim 1, wherein said first bearing insert is substantially semi-cylindrical, said first bearing insert having opposite insert body ends.

6. The engine of claim 5, wherein said insert body ends form an angle with a centerline of said semi-cylindrical first bearing insert of from approximately one hundred eighty one degrees (181°) to approximately two hundred twenty-five degrees (225°).

7. The engine of claim 5, wherein at least one of said insert body ends includes a chamfer at an inside surface thereof.

8. The engine of claim 5, wherein said first bearing insert further comprises at least one tab, said tab extending in a radially outward direction from said first bearing insert.

9. The engine of claim 1, wherein said partial wrap frame assembly includes a frame body, a second shaft engaging mechanism carried by said frame body and engaging said camshaft.

10. The engine of claim 9, wherein said second shaft-engaging mechanism comprises a resiliently-deformable second bearing insert, said second bearing insert engaging said camshaft with a snap fit to thereby pivotally dispose said frame assembly upon said camshaft.

11. The engine of claim 9, wherein said second bearing insert is coupled to said frame body by a snap fit.

12. The engine of claim 9, wherein said frame body defines a substantially semi-cylindrical surface and opposite end portions adjoining said semi-cylindrical surface, said second bearing insert being received and disposed within said semi-cylindrical surface.

13. The engine of claim 12, wherein said opposite end portions of said semi-cylindrical surface taper in a direction away from a centerline of said semi-cylindrical surface.

14. The engine of claim 9,wherein said second shaft engaging mechanism comprises a substantially semi-cylindrical insert body, said insert body having opposite insert body ends.

15. The engine of claim 14, wherein said insert body ends form an angle with a centerline of said semi-cylindrical insert body of from approximately one hundred eighty one degrees (181°) to approximately two hundred twenty-five degrees (225°).

16. The engine of claim 14, wherein at least one of said insert body ends includes a chamfer at an inside surface thereof.

17. The engine of claim 14, wherein said insert body further comprises at least one tab, said tab extending in a radially outward direction from said insert body.

18. The engine of claim 1, further comprising lubricating means associated with at least one of said partial wrap frame assembly and said partial wrap output cam assembly.

* * * * *